US009523263B2

(12) United States Patent
Downie et al.

(10) Patent No.: US 9,523,263 B2
(45) Date of Patent: Dec. 20, 2016

(54) DRILLING TURBINE POWER GENERATION

(71) Applicant: Halliburton Energy Services, Inc., Houston, TX (US)

(72) Inventors: Andrew McPherson Downie, Dunfermline (GB); Christopher Paul Crampton, Menstrie (GB); Victor Gawski, Aberdeenshire (GB)

(73) Assignee: Halliburton Energy Services, Inc., Houston, TX (US)

( * ) Notice: Subject to any disclaimer, the term of this patent is extended or adjusted under 35 U.S.C. 154(b) by 216 days.

(21) Appl. No.: 14/304,182

(22) Filed: Jun. 13, 2014

(65) Prior Publication Data

US 2015/0361766 A1 Dec. 17, 2015

(51) Int. Cl.
*E21B 4/02* (2006.01)
*E21B 41/00* (2006.01)
*F03B 13/02* (2006.01)

(52) U.S. Cl.
CPC ..... *E21B 41/0085* (2013.01); *E21B 4/02* (2013.01); *F03B 13/02* (2013.01)

(58) Field of Classification Search
CPC ..... E21B 4/02; E21B 41/0085
See application file for complete search history.

(56) References Cited

U.S. PATENT DOCUMENTS 4,415,823 A 11/1983 Jurgens
5,626,200 A 5/1997 Gilbert et al.
6,540,032 B1 4/2003 Krueger
7,133,325 B2 11/2006 Kotsonis et al.
2006/0254825 A1 11/2006 Krueger et al.
2009/0057016 A1* 3/2009 Hall ..... E21B 4/14 175/57
2010/0200295 A1 8/2010 Schimanski et al.
2011/0120725 A1 5/2011 Downton et al.
2012/0091732 A1* 4/2012 Fallet ..... E21B 41/0085 290/40 R (Continued)

FOREIGN PATENT DOCUMENTS

WO 2014035397 A1 3/2014
WO 2015191256 A1 12/2015

OTHER PUBLICATIONS

International Search Report and Written Opinion for PCT/US2015/031657 dated Aug. 13, 2015.

*Primary Examiner* — Nicole Coy
(74) *Attorney, Agent, or Firm* — McDermott Will & Emery LLP; Alan Bryson

(57) ABSTRACT

An example drilling turbine includes a turbine power section having a turbine shaft and a plurality of turbine stages axially arranged along the turbine shaft. A turbine bearing section is coupled to the turbine power section and has a drive shaft operatively coupled to the turbine shaft such that rotation of the turbine shaft rotates the drive shaft. The turbine bearing section includes a lower mandrel that houses a portion of the drive shaft rotatable with respect to the lower mandrel, one or more magnets disposed on an inner surface of the lower mandrel, a generator coil coupled to the drive shaft and aligned with the magnets, and one or more sensors coupled to the drive shaft and in electrical communication with the generator coil. The turbine shaft rotates the drive shaft, which rotates the generator coil with respect to the magnets, and thereby generates electrical power for the sensors.

20 Claims, 5 Drawing Sheets

(56) References Cited

U.S. PATENT DOCUMENTS

| | | | | |
|---|---|---|---|---|
| 2012/0126809 | A1* | 5/2012 | Hopper | G01R 33/3808 324/303 |
| 2013/0051177 | A1 | 2/2013 | Vecseri et al. | |
| 2016/0061019 | A1* | 3/2016 | Blang | E21B 7/06 175/26 |

* cited by examiner

DRILLING TURBINE POWER GENERATION

BACKGROUND

The present disclosure is related to oilfield downhole tools and, more particularly, to drilling turbines used for drilling wellbores and generating electrical power.

Drilling of oil and gas wells typically involves the use of several different measurement and telemetry systems to provide data regarding the subsurface formation penetrated by a borehole, and data regarding the state of various drilling mechanics during the drilling process. In measurement-while-drilling (MWD) tools, for example, data is acquired using various sensors located in the drill string as near to the drill bit as is feasible. This data is either stored in downhole memory or transmitted to the surface using assorted telemetry means, such as mud pulse or electromagnetic telemetry devices.

The sensors used while drilling require electrical power and, since it is not feasible to run an electric power supply cable from the surface through the drill string to the sensors, the electrical power must be obtained downhole. In some cases, the sensors may be powered using batteries installed in the drill string at or near the location of the sensors. Such batteries, however, have a finite life and complicate the design of the drill string by requiring a sub/housing that houses the batteries and associated sensor boards. Moreover, batteries take up a substantial amount of space in the drill string and can therefore introduce unwanted flow restrictions for circulating drilling fluid.

In other cases, the sensors may be powered using an electrical power generator included as a separate component in the drill string. For instance, a typical drilling fluid flow-based electromagnetic induction power generator employs multiple rotors coupled to a rotatable shaft and having impeller blades that extend radially therefrom. The impeller blades are placed in the path of a high-pressure flow of drilling fluid derived from the drill string and convert the hydraulic energy of the drilling fluid into rotation of the rotatable shaft. As the rotatable shaft rotates, electrical power is generated in an associated coil generator. Similar to the use of batteries, however, conventional downhole electric power generators require a separate sub/housing that houses the components of the power generator. Moreover, conventional electrical power generators that are separate components typically require the transfer of generated electrical power across separate drilling components or devices, some of which may be rotating at different speeds.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to oilfield downhole tools and, more particularly, to drilling turbines used for drilling wellbores and generating electrical power.

The present disclosure describes the incorporation of electrical power generation directly within a downhole drilling turbine, which eliminates the need for separate power generation or storage features. The embodiments described herein include a coil generator and associated downhole sensors coupled to the drive shaft of a drilling turbine. As the turbine shaft of the drilling turbine is rotated, the drive shaft is simultaneously rotated and the coil generator generates electrical power by being rotated with respect to magnets disposed on the inner walls of a lower mandrel. The generated electrical power is provided directly to various downhole sensors used to measure and report various wellbore and drilling parameters during drilling operations. The presently disclosed embodiments eliminate the need for battery subs and collars between the turbine section and the bearing section of a drilling turbine, which increases directional control of the drilling turbine, eliminates downhole time restrictions associated with the limited storage capacity of batteries, and opens up the potential to generate more power to extend drill run lengths. Moreover, the embodiments discussed herein may allow downhole sensors to be optimally positioned as close to the drill bit as possible.

Figure 1:
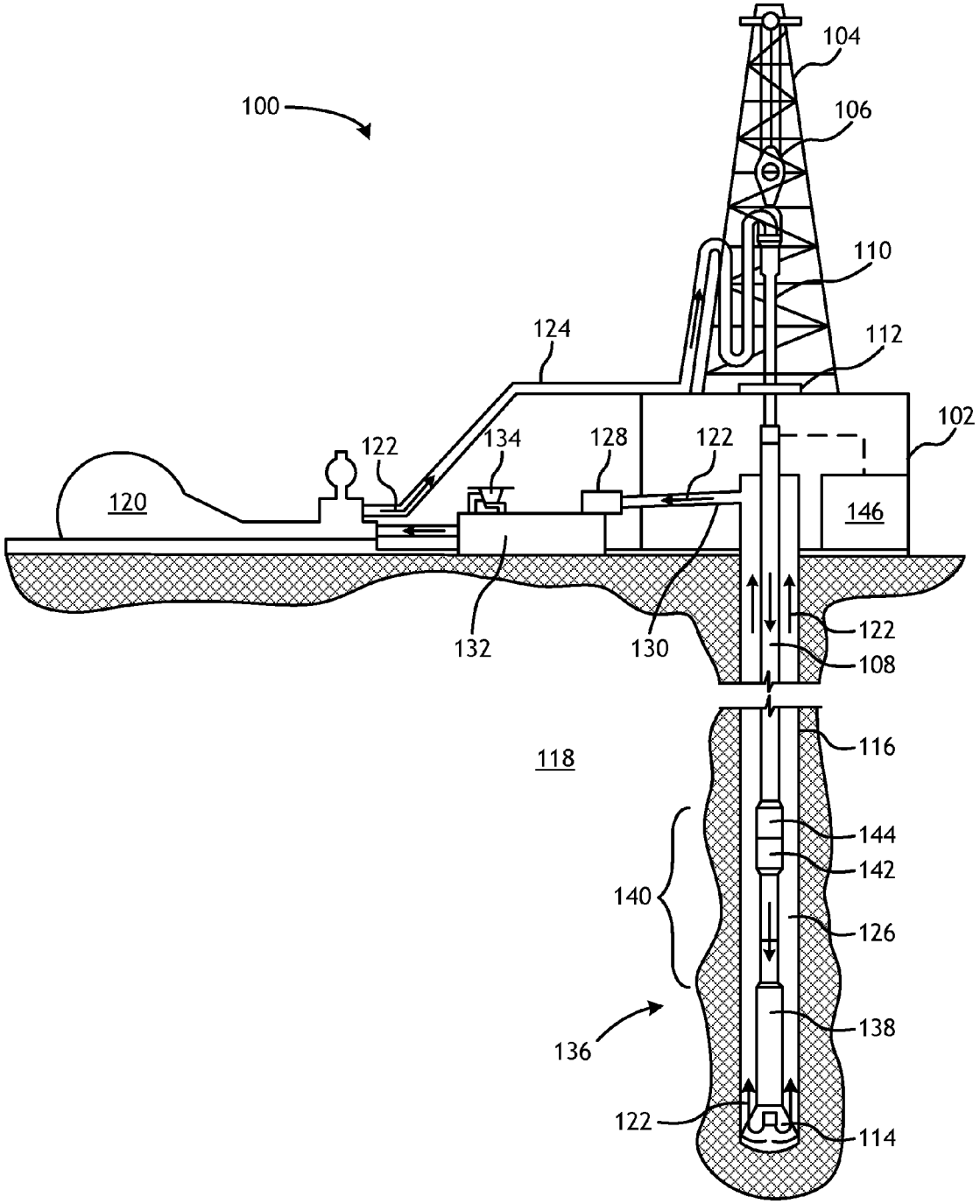
FIG. 1 illustrates an exemplary drilling system that may employ the principles of the present disclosure.

Referring now to FIG. 1, illustrated is an exemplary drilling system 100 that may employ the principles of the present disclosure. It should be noted that while FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated, the drilling system 100 may include a drilling platform 102 that supports a derrick 104 having a traveling block 106 for raising and lowering a drill string 108. The drill string 108 may include, but is not limited to, drill pipe or coiled tubing, as generally known to those skilled in the art. A kelly 110 (or top drive system) supports the drill string 108 as it is lowered through a rotary table 112. A drill bit 114 is attached to the distal end of the drill string 108 and rotated to create a borehole 116 that penetrates various subterranean formations 118.

A pump 120 (e.g., a mud pump) circulates drilling fluid 122 through a feed pipe 124 and to the kelly 110, which conveys the drilling fluid 122 downhole through the interior of the drill string 108 and eventually out through one or more orifices in the drill bit 114. The drilling fluid 122 is then circulated back to the surface via an annulus 126 defined between the drill string 108 and the walls of the borehole 116. At the surface, the recirculated or spent drilling fluid 122 exits the annulus 126 and may be conveyed to one or more solids control units 128 via an interconnecting flow line 130. After passing through the solids control unit 128, a "cleaned" drilling fluid 122 is deposited into a nearby retention pit 132 (i.e., a mud pit). One or more chemicals, fluids, or additives may be added to the drilling fluid 122 via a mixing hopper 134 communicably coupled to or otherwise in fluid communication with the retention pit 132.

As illustrated, the drilling system 100 may further include a bottom hole assembly (BHA) 136 arranged at or near the distal end of the drill string 108. The BHA 136 may include the drill bit 114, a downhole "mud motor" or drilling turbine 138 operatively coupled to the drill bit 114, and a measure-while-drilling (MWD) tool 140 operatively and communicably coupled to the drilling turbine 138. The drilling turbine 138 may be configured to power and otherwise rotate the drill bit 114 during drilling operations. In some embodiments, for example, the drilling turbine 138 may be a turbodrill that includes multiple turbine stages (not shown), where the rotors of each turbine stage are coupled to a turbine shaft that is operatively coupled to the drill bit 114. While circulating through the drilling turbine 138, the drilling fluid 122 acts on the rotors and thereby causes the turbine shaft to rotate and drive the drill bit 114.

The MWD tool 140 may include, among other devices and/or tools, a sensor module 142 and a communications module 144. The sensor module 142 may include various known sensors, devices, and/or gauges used to help a driller or well operator optimize drilling operations. For instance, the sensor module 142 may include formation evaluation sensors and/or logging-while-drilling tools. These sensors and tools are generally known in the art and are therefore not described further. The communications module 144 may be any device or mechanism that facilitates downhole communication with a surface location, such as a computer system 146 arranged at or near the drilling platform 102. The communications module 144 may communicate with the computer system 146 via several techniques including, but not limited to, mud pulse telemetry, electromagnetic telemetry, acoustic telemetry, electrical lines, fiber optic lines, radio frequency transmission, or any combination thereof. In other embodiments, however, the computer system 146 may be located at a remote location and the communications module 144 may be configured to communicate wired and/or wirelessly with the computer system 146 at the remote location.

Figure 2A:
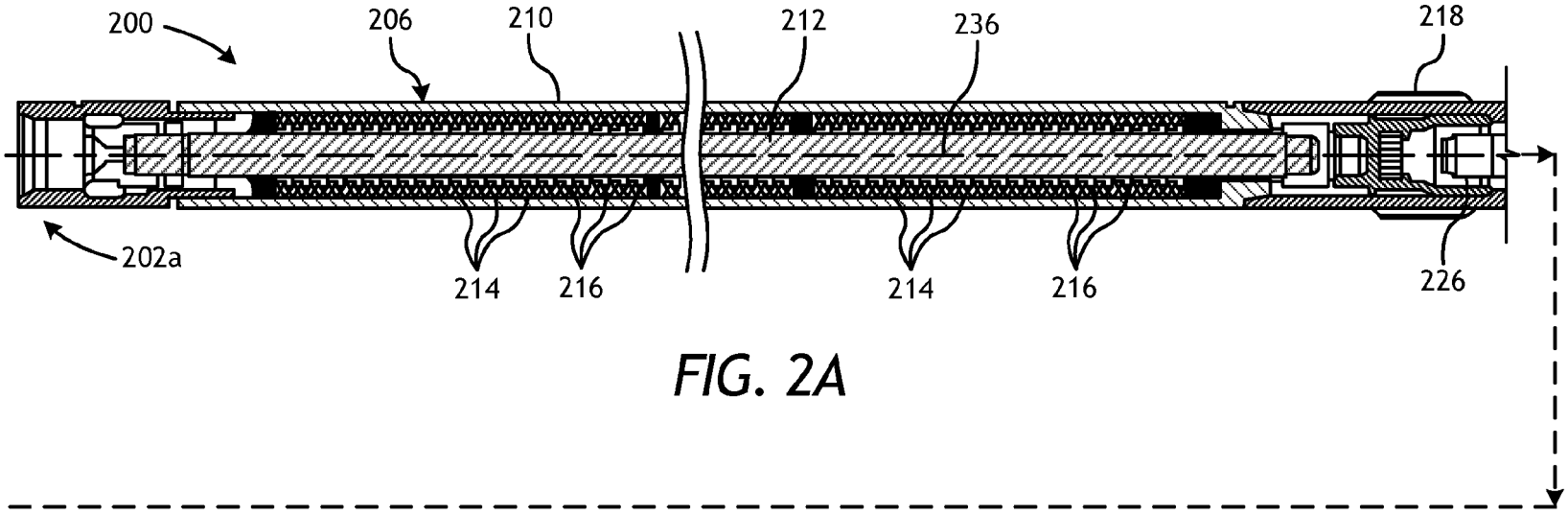
FIGS. 2A and 2B illustrate progressive cross-sectional side views of an exemplary drilling turbine, according to one or more embodiments.
Figure 2B:
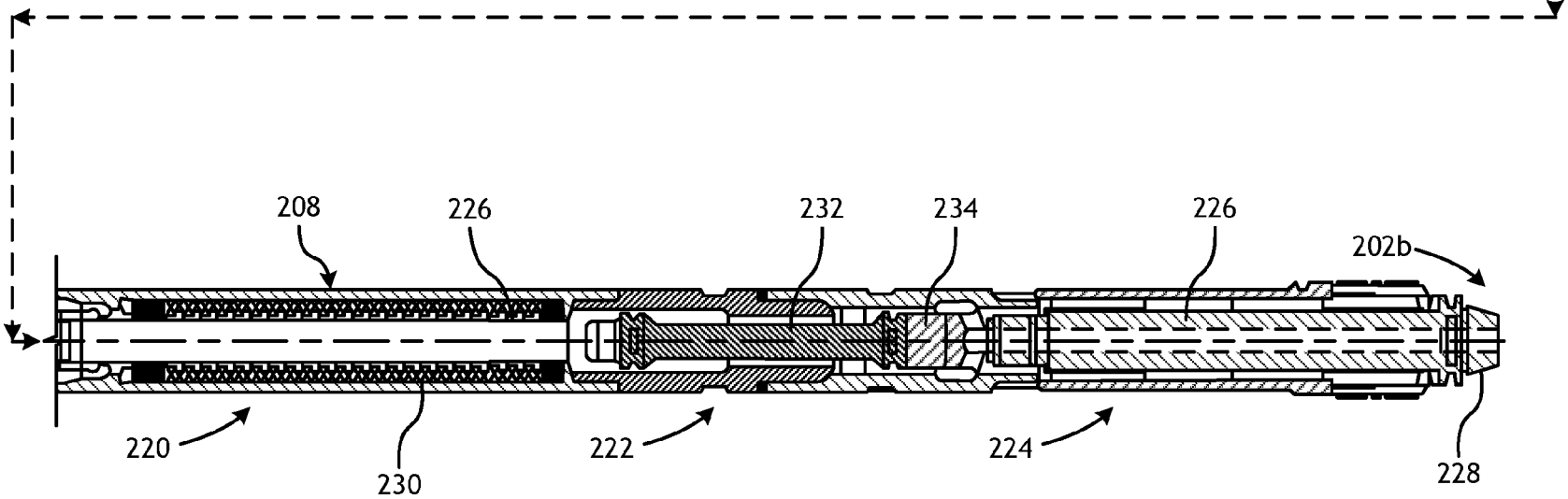

Referring now to FIGS. 2A and 2B, with continued reference to FIG. 1, illustrated are progressive cross-sectional side views of an exemplary drilling turbine 200, according to one or more embodiments. The drilling turbine 200 may be similar to the drilling turbine 138 of FIG. 1 and, therefore, may be used in the drilling system 100 (FIG. 1) described above. The drilling turbine 200 may include a first or uphole end 202*a* and a second or downhole end 202*b*. At the first end 202*a*, the drilling turbine 200 may be operatively coupled to a drill string, such as the drill string 108 of FIG. 1. Alternatively, the drilling turbine 200 may be operatively coupled at its first end 202*a* to an MWD tool, such as the MWD tool 140 of FIG. 1. At the second end 202*b*, the drilling turbine 200 may be configured to be operatively coupled to a drill bit, such as the drill bit 114 of FIG. 1.

Arranged between the first and second ends 202*a,b*, the drilling turbine 200 may include a turbine power section 206, which is generally depicted in FIG. 2A, and a turbine bearing section 208, which is generally depicted in FIG. 2B. The turbine bearing section 208 may be operatively coupled to the turbine power section 206 at a coupling 218. In some embodiments, the coupling 218 may be or otherwise include a rig interchangeable stabilizer configured to help stabilize and/or centralize the drilling turbine 200 within a borehole being drilled.

The turbine power section 206 may include a turbine housing 210 and a turbine shaft 212 rotatably mounted within the turbine housing 210 and extending longitudinally therein. A plurality of stator blades 214 may extend radially inward from the inner surface of the turbine housing 210, and a plurality of rotors 216 may be fixedly attached to the turbine shaft 212 such that rotation of the rotors 216 correspondingly rotates the turbine shaft 212, and vice versa. In some embodiments, the rotors 216 may be shrink fitted onto the turbine shaft 212. In other embodiments, however, the rotors 216 may be attached to the turbine shaft 212 using mechanical fasteners (e.g., screws, bolts, pins, rings, etc.) or by being welded or brazed thereto.

Each rotor 216 provides or defines a plurality of impeller blades (not labeled) that extend radially outward toward the turbine housing 210 and are interleaved with the stator blades 214. Axially adjacent sets of impeller blades and stator blades 214 combine to form corresponding turbine stages that are axially arranged along the length of the turbine shaft 212. While a certain number of turbine stages is depicted in FIG. 2A, those skilled in the art will readily appreciate that more or less turbine stages than what is depicted may be employed in the turbine power section 206, without departing from the scope of the disclosure. Indeed, the turbine power section 206 may include between about 80 and about 150 turbine stages in accordance with the present disclosure. However, it will be appreciated that less than 80 turbine stages or more than 150 turbine stages may equally be employed in the turbine power section 206, without departing from the scope of the disclosure.

In some embodiments, as illustrated, the turbine bearing section 206 may include a thrust bearing mandrel 220, an adjustable bent housing 222, and a lower mandrel 224. In other embodiments, one or both of the thrust bearing mandrel 220 and the adjustable bent housing 222 may be omitted from the turbine bearing section 206 or otherwise included as an integral part of the lower mandrel 224. A drive shaft 226 may be rotatable mounted within the turbine bearing section 208 and extend longitudinally through the thrust bearing mandrel 220, the adjustable bent housing 222, and the lower mandrel 224. The coupling 218 may help to facilitate the transfer rotational torque from the turbine shaft 212 to the drive shaft 226. At or near the second end 202*b* of the drilling turbine 200, the drive shaft 226 may include or otherwise provide a drill bit connection 228 used to operatively couple a drill bit (e.g., the drill bit 114 of FIG. 1) to the drive shaft 226.

Within the thrust bearing mandrel 220, the drive shaft 226 may be axially and radially supported by a thrust bearing pack 230 encompassing a series of thrust bearings. The thrust bearing pack 230 may be configured to assume axial thrust loads experienced by the drive shaft 226 during drilling operations. In some embodiments, a torsional flex shaft 232 may be included in the drive shaft 226 and may interpose upper and lower portions of the drive shaft 226. As depicted, the torsional flex shaft 232 may be rotatably mounted within the adjustable bent housing 222 and operatively coupled at each end to the upper and lower portions of the drive shaft 226. In embodiments where the torsional flex shaft 232 is used, a flow crossover 234 may operatively couple the torsional flex shaft 232 to the lower portion of the drive shaft 226. As described in more detail below, the flow crossover 234 may be configured to divert fluid flow (i.e., drilling fluid) circulating through the upper portion of the drive shaft 226 and the adjustable bent housing 222 into the lower portion of the drive shaft 226.

In exemplary operation of the drilling turbine 200, a fluid, such as the drilling fluid 122 of FIG. 1, is conveyed under pressure into the turbine power section 206 and received by a first turbine stage. More particularly, the drilling fluid 122 is received by a first set of stator blades 214, which change the direction of the drilling fluid 122 and direct it into axially adjacent impeller blades of a first rotor 216. The resulting impulse of fluid energy impacting the impeller blades urges the rotor 216 to rotate about its central axis 236, which, in turn, correspondingly urges the turbine shaft 212 to rotate about the central axis 236. With diminished kinetic energy, the drilling fluid 122 then exits the first turbine stage and proceeds to an axially adjacent second turbine stage where the drilling fluid 122 acts on the stator blades 214 and the rotor 216 of the second turbine stage and further causes the rotor 216 and the turbine shaft 212 to rotate. This process continues until the drilling fluid 122 eventually circulates through all the turbine stages and is thereafter conveyed into the turbine bearing section 208 and, more particularly, into the drive shaft 226. The drilling fluid 122 circulates through the drive shaft 226 until reaching the drill bit 114 (FIG. 1) attached at the drill bit connection 228. The drill bit 114 then ejects the drilling fluid 122 into the annulus 126 (FIG. 1) so that it can be recirculated back to the drilling platform 102 (FIG. 1) for reconditioning, as described above.

Rotating the turbine shaft 212 correspondingly results in the rotation of the drive shaft 226 and the drill bit 114 (FIG. 1), which are operatively coupled thereto via the coupling 218. Accordingly, the flow energy of the drilling fluid 122 is converted to mechanical energy received by the turbine shaft 212 and drive shaft 226 in the form of rotational speed and torque. The actual rotational speed of the drill bit 114 may be dependent on several factors including, but not limited to, the torque generated at the drill bit 114 as it contacts the surrounding formation 118 (FIG. 1), the type of rock being cut through in the formation 118, the type of drill bit 114 being used, and the flow rate of the drilling fluid 122 through the turbine power section 206.

According to the present disclosure, rotation of the drive shaft 226 may also serve to generate electrical power that may be conveyed to and consumed by one or more near-bit downhole sensors, thereby eliminating the need for separate power generation and/or storage features (i.e., batteries). During drilling operations, it is desirable to place downhole sensors as close to a drill bit as possible in order to obtain the most accurate drill bit directional readings. Current technology for powering downhole sensors, however, imposes restrictions on sensor-to-drill bit length, battery life, and the amount of power that can be stored or transmitted for downhole use.

The embodiments described herein overcome these restrictions by incorporating an onboard generator driven directly by the drilling turbine 200. Those skilled in the art will readily appreciate that this may eliminate the need for battery subs and collars between the turbine power section 206 and the turbine bearing section 208 or within the drilling turbine 200 as a whole. As will be appreciated, this may increase directional control of the drilling turbine 200, eliminate downhole time restrictions associated with the limited storage capacity of batteries, and open up the potential to generate additional power that will allow well operators to extend drill times and add new features. Moreover, by removing batteries from the downhole sensors, a well operator may be able to arrange downhole sensors directly on the drive shaft 226 and effectively reduce the sensor-to-drill bit length. As a result, the downhole sensors may be positioned at an optimum position within the drilling turbine 200 (i.e., as close to the drill bit as possible). In some cases, for instance, downhole sensors may be able to be placed within one to two feet from the drill bit using the presently described embodiments.

Figure 3:
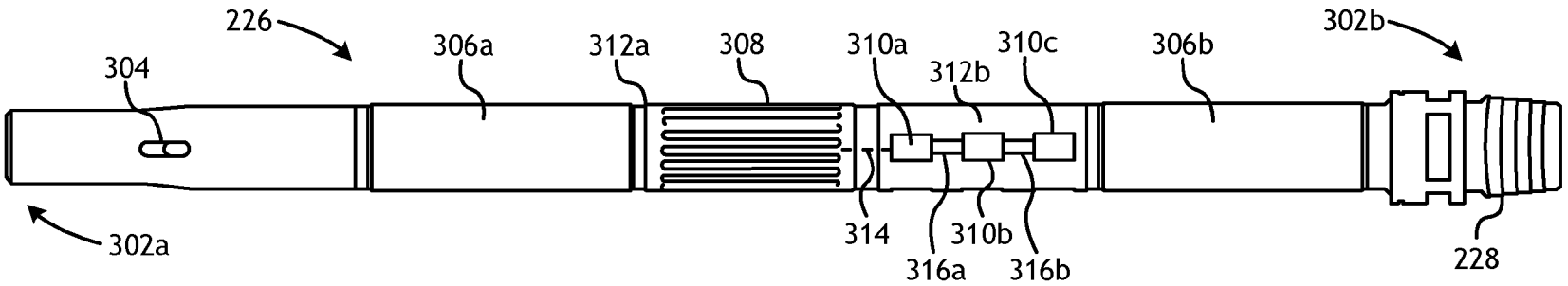
FIG. 3 illustrates a side view of an exemplary embodiment of the drive shaft of FIG. 2B, according to the present disclosure.

Referring now to FIG. 3, with continued reference to FIGS. 2A-2B, illustrated is a side view of an exemplary embodiment of the drive shaft 226, according to the present disclosure. More particularly, the drive shaft 226 depicted in FIG. 3 corresponds to the lower portion of the drive shaft 226 arranged within the lower mandrel 224 (FIG. 2B) and operatively coupled to the torsional flex shaft 232 (FIG. 2B) via the flow crossover 234 (FIG. 2B). However, it will be appreciated that in other embodiments the drive shaft 226 may be operatively coupled directly to the turbine shaft 212 (FIG. 2A), without departing from the scope of the disclosure.

As illustrated, the drive shaft 226 may include a proximal end 302*a* and a distal end 302*b*. Torque from the turbine shaft 212 (FIG. 2A) may be transferred to the drive shaft 226 at the proximal end 302*a*, and the drill bit connection 228 is provided at the distal end 302*b* for attaching the drive shaft 226 to a drill bit (e.g., the drill bit 114 of FIG. 1). At or near the proximal end 302*a*, one or more flow ports 304 (one shown) may be defined in the drive shaft 226. The flow ports 304 may be configured to receive a flow of fluid (e.g., the drilling fluid 122 of FIG. 1) from the flow crossover 234 (FIG. 2B) and convey that fluid into a central conduit (shown in FIG. 5B as central conduit 504) defined within and extending along an axial length of the drive shaft 226. After flowing through the central conduit, the fluid exits the drive shaft 226 into the drill bit 114 (FIG. 1) at the drill bit connection 228.

The drive shaft 226 may further include an upper bearing surface 306*a*and a lower bearing surface 306*b*. The upper and lower bearing surfaces 306*a,b* may be engaged with corresponding radial bearings (shown in FIG. 5B as upper and lower radial bearings 502*a* and 502*b*) in order to radially support the drive shaft 226 within the lower mandrel 224 (FIG. 2B).

As illustrated, the drive shaft 226 may further include a generator coil 308 and one or more sensors 310 (three shown as sensors 310*a*, 310*b*, and 310*c*) arranged on the drive shaft 226. In some embodiments, one or both of the generator coil 308 and the sensors 310*a-c* may be directly attached to the outer surface of the drive shaft 226 or otherwise embedded therein. In other embodiments, however, one or both of the generator coil 308 and the sensors 310*a-c* may be arranged on corresponding sleeve components 312*a* and 312*b*, respectively, as illustrated. The sleeve components 312*a,b* may be secured to the drive shaft 226 and thereby secure the generator coil 308 and the sensors 310*a-c* thereto. The sleeve components 312*a,b* may be coupled or otherwise attached to the drive shaft via several techniques including, but not limited to, mechanical fasteners (e.g., screws, bolts, pins, rings, etc.), shrink-fitting, compression fitting, adhesives, welding, brazing, any combination thereof, and the like. In some embodiments, the sleeve components 312*a,b* may be removable from the drive shaft 226 and otherwise interchangeable with other sleeve components (not shown) of different sizes or configurations. As will be appreciated, this may prove advantageous in providing differing types and/or sizes of generator coils and/or sensors that may be used in conjunction with the drive shaft 226 for differing drilling operations.

The generator coil 308 may include or otherwise provide multiple windings of a metal wire (e.g., copper) or the like through which a current may flow upon being exposed to a time-varying magnetic field. The electrical power generated by the generator coil 308 may be conveyed directly to the sensors 310*a-c* via one or more electrical conductor elements 314 (one shown) extending therebetween. Accordingly, generator coil 308 may be hardwired to at least one of the sensors 310*a-c*. In some embodiments, additional electrical conductor elements 316 (shown as elements 316*a*and 316*b*) may communicably couple the sensors 310*a-c* and may be configured to facilitate the transfer of electrical power and/or data therebetween.

The sensors 310*a-c* may be any type of downhole sensor known to those skilled in the art and desirable to be placed as close as possible to the drill bit 114 (FIG. 1). For example, the sensors 310*a-c* may include, but are not limited to, an inclination sensor, a gamma ray sensor, an azimuth sensor, a rotations-per-minute (rpm) sensor, a weight-on-bit sensor, a torque-on-bit sensor, an axial sensor, a torsional sensor, a lateral vibration sensor, a temperature sensor, and a pressure sensor. In other embodiments, one or more of the sensors 310*a-c* may be replaced with a battery, a capacitor, or another type of energy storage device. In such embodiments, the energy storage device may be charged by the generator coil 308 and the stored electrical power may subsequently be tapped and consumed by the sensors 310*a-c* when the drive shaft 226 is not being rotated (i.e., no electrical power is being generated). Accordingly, one or more of the sensors 310*a-c* may be communicably coupled to the energy storage device, such as via one of the electrical conductor elements 316*a,b*.

Figure 4A:
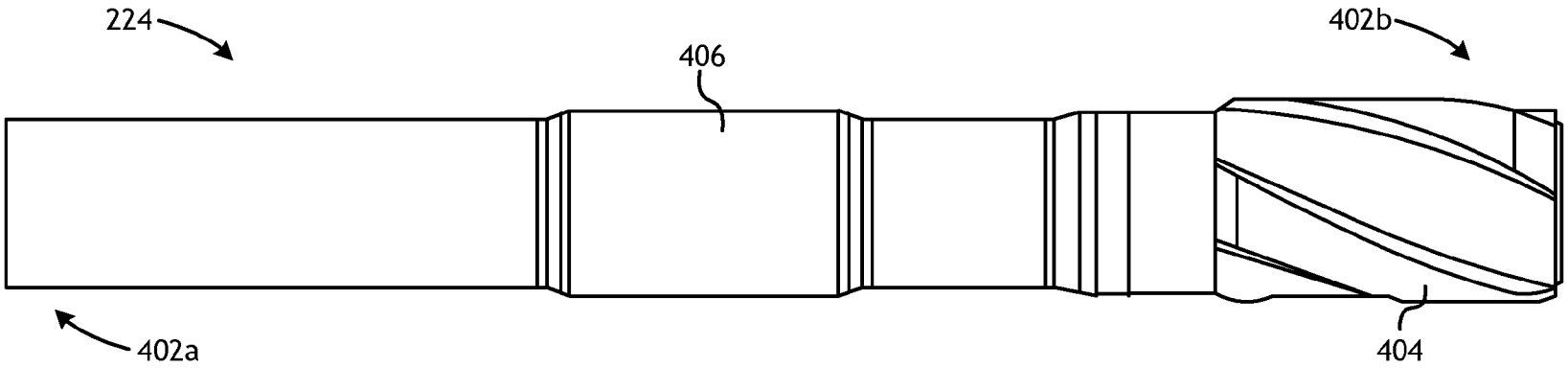
FIGS. 4A-4C illustrate various views of an exemplary embodiment of the lower mandrel of FIG. 2B, according to the present disclosure.
Figure 4B:
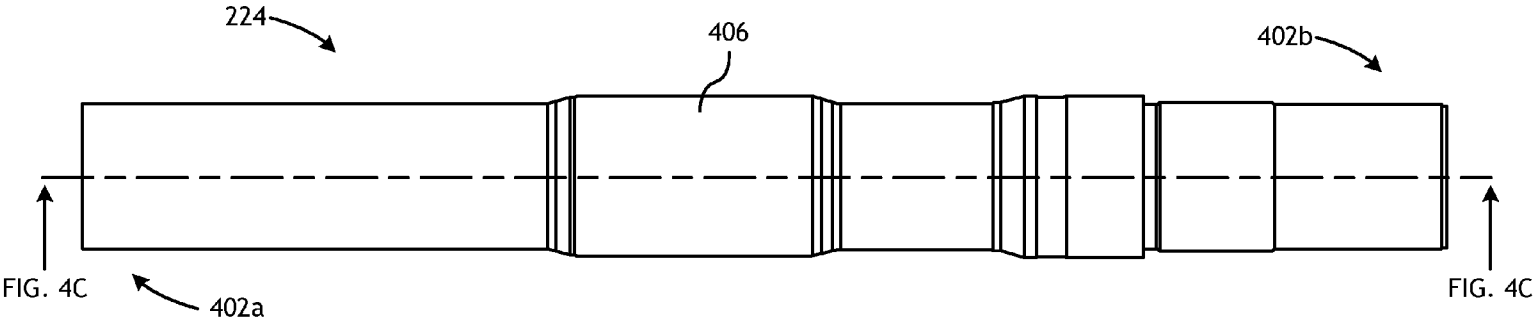
Figure 4C:
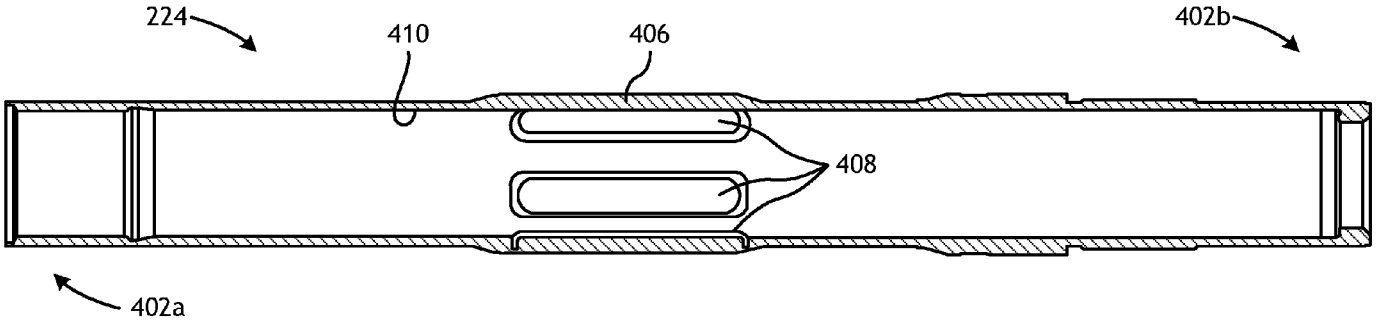

Referring now to FIGS. 4A-4C, with continued reference to FIGS. 2A-2B, illustrated are various views of an exemplary embodiment of the lower mandrel 224, according to the present disclosure. More particularly, FIGS. 4A and 4B depict side views of two embodiments of the lower mandrel 224, and FIG. 4C depicts a cross-sectional side view of the lower mandrel 224 of FIG. 4B. As discussed above, the lower mandrel 224 may be configured to house the drive shaft 226 and, more particularly, the lower portion of the drive shaft 226 described above with reference to FIG. 3.

The lower mandrel 224 may be a generally elongate and cylindrical structure having a proximal end 402*a* and a distal end 402*b*. In some embodiments, the proximal end 402*a* may be operatively coupled to the adjustable bent housing 222 (FIG. 2B). In other embodiments, however, the proximal end 402*a* may be operatively coupled to the thrust bearing mandrel 220 or the turbine power section 206, without departing from the scope of the disclosure. In at least one embodiment, as depicted in FIG. 4A, a stabilizer 404 may be arranged on the lower mandrel 224 at or near the distal end 402*b*. The stabilizer 404 may be a near-bit stabilizer, as known to those skilled in the art, and may function to mechanically stabilize the drill bit 114 (FIG. 1) during drilling operations in order to avoid unintentional sidetracking and/or vibrations. As depicted in FIGS. 4B and 4C, the stabilizer 404 is omitted from the lower mandrel 224.

The lower mandrel 224 may further include a magnet carrier 406 defined or otherwise provided at an intermediate location along the length of the lower mandrel 224. In some embodiments, as illustrated, the magnet carrier 406 may exhibit a larger outer diameter than the axially adjacent portions of the lower mandrel 224. As best seen in FIG. 4C, the larger outer diameter of the magnet carrier 406 may prove advantageous in accommodating one or more magnets 408 arranged circumferentially about the inner radial surface of the magnet carrier or the inner radial surface 410 of the lower mandrel 224. The magnets 408 may be permanent magnets, rare-earth magnets, or a combination thereof.

The magnet carrier 406, and its associated magnets 408, may be configured to be axially aligned with the generator coil 308 of FIG. 3 when the drive shaft 226 is arranged within the lower mandrel 224 such that the magnets 408 are radially offset from the generator coil 308. Accordingly, the size and shape of the magnets 408 may be based on a size (e.g., axial length) and shape of the generator coil 308. In the illustrated embodiment, for instance, the magnets 408 are depicted as elongate structures configured to be radially aligned with a similarly sized elongate generator coil 308. In other embodiments, however, the magnets 408 may be circular, ovular, polygonal, etc., without departing from the scope of the disclosure.

Figure 5A:
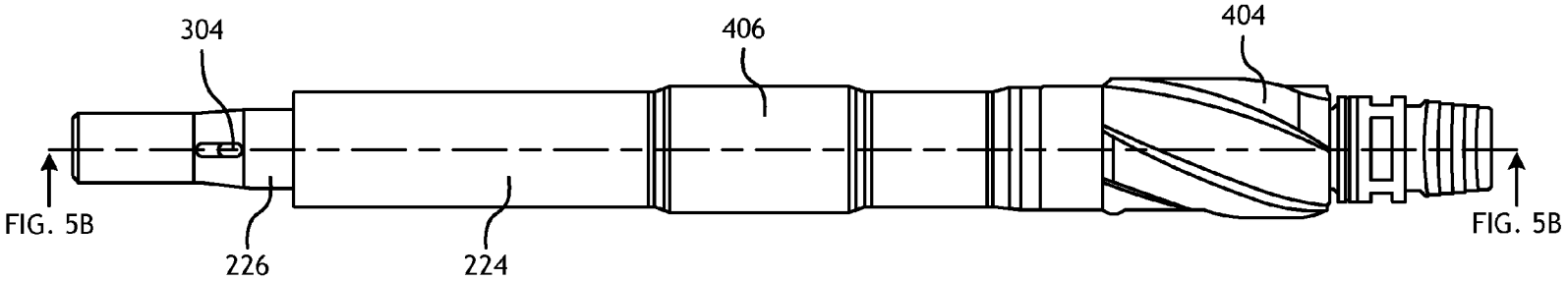
FIGS. 5A and 5B illustrate views of an exemplary lower mandrel assembly, according to one or more embodiments.
Figure 5B:
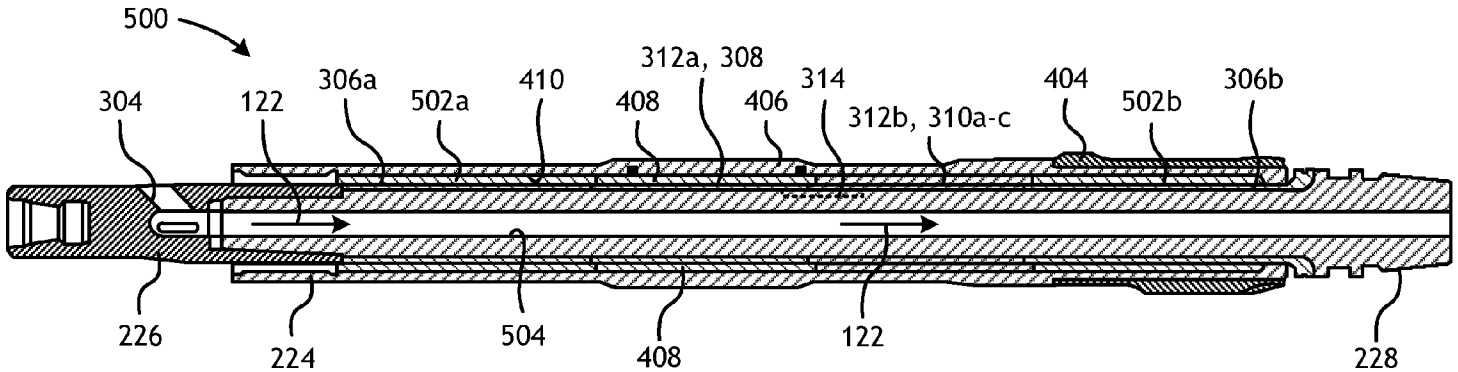

Referring now to FIGS. 5A and 5B, with continued reference to FIGS. 3 and 4A-4C, illustrated are views of an exemplary lower mandrel assembly 500, according to one or more embodiments. More particularly, FIG. 5A depicts a side view of the lower mandrel assembly 500 and FIG. 5B depicts a cross-sectional side view of the lower mandrel assembly 500. As illustrated, the lower mandrel assembly 500 may include the drive shaft 226 arranged for rotation within the lower mandrel 224. As best seen in FIG. 5B, upper and lower radial bearings 502*a* and 502*b* may interpose the upper and lower bearing surfaces 306*a*and 306*b* of the drive shaft 226, respectively, and the inner radial surface 410 of the lower mandrel 224. The upper and lower radial bearings 502*a,b* may help facilitate rotation of the drive shaft 226 with respect to the lower mandrel 224.

The drive shaft 226 may be disposed within the lower mandrel 224 such that the upper sleeve component 312*a* and/or the generator coil 308 arranged radially inward from the magnets 408 and the magnet carrier 406 of the lower mandrel 224.

In exemplary operation of the lower mandrel assembly 500, the turbine power section 206 (FIG. 2A) is operated as described above in order to rotate its associated turbine shaft 212 (FIG. 2A). The drilling fluid (e.g., the drilling fluid 122 of FIG. 1) used to rotate the turbine shaft 212 may eventually enter the lower mandrel assembly 500 and, more particularly, the drive shaft 226 via the flow ports 304 defined in the drive shaft 226. The drilling fluid 122 may then circulate through the drive shaft 226 via a central conduit 504 until exiting at the drill bit connection 228 where it is conveyed into a drill bit (e.g., the drill bit 114 of FIG. 1) coupled to the drive shaft 226 at the drill bit connection 228.

Rotating the turbine shaft 212 correspondingly results in the rotation of the drive shaft 226, which is operatively coupled thereto. As the drive shaft 226 rotates, the coil generator 308 correspondingly rotates with respect to the magnets 408, thereby creating a time-varying magnetic field that results in electrical power (i.e., current) being generated and otherwise flowing in the generator coil 308. The resulting electrical power from the generator coil 308 may then be conveyed directly to the sensors 310*a-c* via the electrical conductor element(s) 314 extending therebetween. The electrical power may be received and consumed by the sensors 310*a-c* in order to monitor various drilling and/or downhole parameters and conditions. Accordingly, the electrical power may be generated, accumulated, and directly consumed on the drive shaft 226 extending within the lower mandrel 224 at or near the drill bit (e.g., the drill bit 114 of FIG. 1).

In the above-described embodiments, the coil generator 308 and the sensors 310*a-c* are depicted as being coupled to the drive shaft 226 and the magnets 408 are depicted as being arranged on the lower mandrel 224. Embodiments are also contemplated herein, however, where the coil generator 308 and the sensors 310*a-c* are arranged on the lower mandrel 224 and the magnets are alternatively arranged on the drive shaft 226, without departing from the scope of the disclosure.

Moreover, in the above-described embodiments, the coil generator 308 and associated magnets 408 are depicted as being housed in the lower mandrel assembly 500, but could equally be installed at or near the first or uphole end 202*a* (FIG. 2A) of the drilling turbine 200 (FIG. 2A). In such an embodiment, the coil generator 308 and associated magnets 408 may be arranged above (i.e., to the left in FIG. 2A) the turbine stages, with the coil generator 308 arranged on the turbine shaft 212 (FIG. 2A) and the magnets 408 radially offset therefrom and arranged on the turbine housing 210 (FIG. 2A). Electrical power generated by the coil generator 308 and associated magnets 408 in such an arrangement may be used to power an MWD tool (e.g., the MWE tool 140 of FIG. 1) for communication back to a surface location. Alternatively, the coil generator 308 and associated magnets 408 may be arranged between the turbine power and bearing sections 206, 208 (FIGS. 2A and 2B), without departing from the scope of the disclosure.

Embodiments disclosed herein include:

A. A drilling turbine that includes a turbine power section including a turbine housing and a turbine shaft rotatably mounted within the turbine housing, wherein a plurality of turbine stages are axially arranged within the turbine housing and operable to rotate the turbine shaft, a turbine bearing section coupled to the turbine power section and having a drive shaft operatively coupled to the turbine shaft such that rotation of the turbine shaft rotates the drive shaft, the turbine bearing section including a lower mandrel that houses at least a portion of the drive shaft, and the drive shaft being rotatable with respect to the lower mandrel, one or more magnets circumferentially disposed on an inner surface of the lower mandrel, a generator coil coupled to the drive shaft and axially aligned such that the one or more magnets are radially offset from the generator coil, and one or more sensors coupled to the drive shaft and in direct electrical communication with the generator coil via at least one electrical conductor element, wherein the turbine shaft rotates the drive shaft, which rotates the generator coil with respect to the one or more magnets and thereby generates electrical power that is conveyed directly to the one or more sensors from the generator coil.

B. A lower mandrel assembly of a drilling turbine that includes a lower mandrel, one or more magnets circumferentially arranged on an inner surface of the lower mandrel, a drive shaft arranged for rotation within the lower mandrel, a generator coil coupled to the drive shaft and axially aligned such that the one or more magnets are radially offset from the generator coil, and one or more sensors coupled to the drive shaft and in direct electrical communication with the generator coil via at least one electrical conductor element, wherein, as the drive shaft rotates, the generator coil rotates with respect to the one or more magnets and thereby generates electrical power that is conveyed directly to the one or more sensors from the generator coil.

C. A method of drilling that includes introducing a drill string into a wellbore, the drill string including a drilling turbine having a turbine power section coupled to a turbine bearing section, conveying a drilling fluid through the drill string and into a plurality of turbine stages axially arranged along a turbine shaft of the turbine power section, circulating the drilling fluid through the plurality of turbine stages and thereby rotating the turbine shaft, rotating a drive shaft operatively coupled to the turbine shaft, the drive shaft being rotatably arranged at least partially within a lower mandrel of the turbine bearing section, wherein one or more magnets are circumferentially disposed on an inner surface of the lower mandrel, generating electrical power with a generator coil coupled to the drive shaft and axially aligned such that the one or more magnets are radially offset from the generator coil, and conveying the electrical power to one or more sensors in direct electrical communication with the generator coil via at least one electrical conductor element.

Each of embodiments A, B, and C may have one or more of the following additional elements in any combination: Element 1: wherein the turbine bearing section further comprises a thrust bearing mandrel operatively coupled to the turbine housing, and an adjustable bent housing interposing the thrust bearing mandrel and the lower mandrel. Element 2: further comprising a torsional flex shaft arranged within the adjustable bent housing and interposing upper and lower portions of the drive shaft. Element 3: wherein one or both of the generator coil and the one or more sensors is directly attached to an outer surface of the drive shaft. Element 4: wherein one or both of the generator coil and the one or more sensors is arranged on a corresponding sleeve component secured to the drive shaft for rotation therewith. Element 5: wherein the one or more sensors comprise downhole sensors selected from the group consisting of an inclination sensor, a gamma ray sensor, an azimuth sensor, a rotations-per-minute sensor, a weight-on-bit sensor, a torque-on-bit sensor, an axial sensor, a torsional sensor, a lateral vibration sensor, a temperature sensor, and a pressure sensor. Element 6: wherein a drill bit connection is provided at a distal end of the drive shaft and used to couple a drill bit to the drive shaft for rotation therewith.

Element 7: further comprising one or more radial bearings interposing the drive shaft and the inner surface of the lower mandrel to help facilitate rotation of the drive shaft with respect to the lower mandrel. Element 8: further comprising a magnet carrier provided at an intermediate location along the lower mandrel, the one or more magnets being arranged within the magnet carrier. Element 9: wherein one or both of the generator coil and the one or more sensors is directly attached to an outer surface of the drive shaft. Element 10: wherein one or both of the generator coil and the one or more sensors is arranged on a corresponding sleeve component secured to the drive shaft for rotation therewith. Element 11: wherein the one or more sensors comprise downhole sensors selected from the group consisting of an inclination sensor, a gamma ray sensor, an azimuth sensor, a rotations-per-minute sensor, a weight-on-bit sensor, a torque-on-bit sensor, an axial sensor, a torsional sensor, a lateral vibration sensor, a temperature sensor, and a pressure sensor. Element 12: further comprising one or more energy storage devices coupled to the drive shaft and in direct electrical communication with the generator coil via the at least one electrical conductor element, the generator coil providing electrical power to the one or more energy storage devices to be stored as stored electrical power. Element 13: wherein the one or more energy storage devices is communicably coupled to at least one of the one or more sensors and the at least one of the one or more sensors is configured to consume the stored electrical power.

Element 14: wherein a drill bit connection is provided at a distal end of the drive shaft to connect a drill bit to the drive shaft, the method further comprising extending a length of the wellbore with the drill bit as the drive shaft rotates. Element 15: further comprising directly attaching one or both of the generator coil and the one or more sensors to an outer surface of the drive shaft. Element 16: wherein one or both of the generator coil and the one or more sensors is arranged on a corresponding sleeve component, the method further comprising securing the corresponding sleeve component to the drive shaft for rotation therewith. Element 17: further comprising obtaining measurements with the one or more sensors while the drive shaft rotates, wherein the one or more sensors comprise downhole sensors selected from the group consisting of an inclination sensor, a gamma ray sensor, an azimuth sensor, a rotations-per-minute sensor, a weight-on-bit sensor, a torque-on-bit sensor, an axial sensor, a torsional sensor, a lateral vibration sensor, a temperature sensor, and a pressure sensor. Element 18: wherein one or more energy storage devices are coupled to the drive shaft and in direct electrical communication with the generator coil via the at least one electrical conductor element, the method further comprising conveying electrical power to the one or more energy storage devices with the generator coil to be stored as stored electrical power, and consuming the stored electrical power with at least one of the one or more sensors communicably coupled to the one or more energy storage devices.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A drilling turbine, comprising:

a turbine power section including a turbine housing and a turbine shaft rotatably mounted within the turbine housing, wherein a plurality of turbine stages are axially arranged within the turbine housing and operable to rotate the turbine shaft;

a turbine bearing section coupled to the turbine power section and having a drive shaft operatively coupled to the turbine shaft such that rotation of the turbine shaft rotates the drive shaft, the turbine bearing section including a lower mandrel that houses at least a portion of the drive shaft, and the drive shaft being rotatable with respect to the lower mandrel;

one or more magnets circumferentially disposed on an inner surface of the lower mandrel;

a generator coil coupled to the drive shaft and axially aligned such that the one or more magnets are radially offset from the generator coil; and one or more sensors coupled to the drive shaft and in direct electrical communication with the generator coil via at least one electrical conductor element, wherein the turbine shaft rotates the drive shaft, which rotates the generator coil with respect to the one or more magnets and thereby generates electrical power that is conveyed to the one or more sensors from the generator coil.

2. The drilling turbine of claim 1, wherein the turbine bearing section further comprises:

a thrust bearing mandrel operatively coupled to the turbine housing; and an adjustable bent housing interposing the thrust bearing mandrel and the lower mandrel.

3. The drilling turbine of claim 2, further comprising a torsional flex shaft arranged within the adjustable bent housing and interposing upper and lower portions of the drive shaft.

4. The drilling turbine of claim 1, wherein one or both of the generator coil and the one or more sensors is directly attached to an outer surface of the drive shaft.

5. The drilling turbine of claim 1, wherein one or both of the generator coil and the one or more sensors is arranged on a corresponding sleeve component secured to the drive shaft for rotation therewith.

6. The drilling turbine of claim 1, wherein the one or more sensors comprise downhole sensors selected from the group consisting of an inclination sensor, a gamma ray sensor, an azimuth sensor, a rotations-per-minute sensor, a weight-on-bit sensor, a torque-on-bit sensor, an axial sensor, a torsional sensor, a lateral vibration sensor, a temperature sensor, and a pressure sensor.

7. The drilling turbine of claim 1, wherein a drill bit connection is provided at a distal end of the drive shaft and used to couple a drill bit to the drive shaft for rotation therewith.

8. A lower mandrel assembly of a drilling turbine, comprising:

a lower mandrel that provides a magnet carrier exhibiting an outer diameter larger than axially adjacent portions of the lower mandrel;

one or more magnets circumferentially arranged on an inner surface of the magnet carrier;

a drive shaft arranged for rotation within the lower mandrel;

a generator coil coupled to the drive shaft and axially aligned such that the one or more magnets are radially offset from the generator coil; and one or more sensors coupled to the drive shaft and in direct electrical communication with the generator coil via at least one electrical conductor element, wherein, as the drive shaft rotates, the generator coil rotates with respect to the one or more magnets and thereby generates electrical power that is conveyed to the one or more sensors from the generator coil.

9. The lower mandrel assembly of claim 8, further comprising one or more radial bearings interposing the drive shaft and the inner surface of the lower mandrel to help facilitate rotation of the drive shaft with respect to the lower mandrel.

10. The lower mandrel assembly of claim 8, wherein one or both of the generator coil and the one or more sensors is directly attached to an outer surface of the drive shaft.

11. The lower mandrel assembly of claim 8, wherein one or both of the generator coil and the one or more sensors is arranged on a corresponding sleeve component secured to the drive shaft for rotation therewith.

12. The lower mandrel assembly of claim 8, wherein the one or more sensors comprise downhole sensors selected from the group consisting of an inclination sensor, a gamma ray sensor, an azimuth sensor, a rotations-per-minute sensor, a weight-on-bit sensor, a torque-on-bit sensor, an axial sensor, a torsional sensor, a lateral vibration sensor, a temperature sensor, and a pressure sensor.

13. The lower mandrel assembly of claim 8, further comprising one or more energy storage devices coupled to the drive shaft and in direct electrical communication with the generator coil via the at least one electrical conductor element, the generator coil providing electrical power to the one or more energy storage devices to be stored as stored electrical power.

14. The lower mandrel assembly of claim 13, wherein the one or more energy storage devices is communicably coupled to at least one of the one or more sensors and the at least one of the one or more sensors is configured to consume the stored electrical power.

15. A method of drilling, comprising:

introducing a drill string into a wellbore, the drill string including a drilling turbine having a turbine power section coupled to a turbine bearing section;

conveying a drilling fluid through the drill string and into a plurality of turbine stages axially arranged along a turbine shaft of the turbine power section;

circulating the drilling fluid through the plurality of turbine stages and thereby rotating the turbine shaft;

rotating a drive shaft operatively coupled to the turbine shaft, the drive shaft being rotatably arranged at least partially within a lower mandrel of the turbine bearing section, wherein the lower mandrel provides a magnet carrier exhibiting an outer diameter larger than axially adjacent portions of the lower mandrel and one or more magnets are circumferentially disposed on an inner surface of the magnet carrier;

generating electrical power with a generator coil coupled to the drive shaft and axially aligned such that the one or more magnets are radially offset from the generator coil; and conveying the electrical power to one or more sensors in electrical communication with the generator coil via at least one electrical conductor element.

16. The method of claim 15, wherein a drill bit connection is provided at a distal end of the drive shaft to connect a drill bit to the drive shaft, the method further comprising extending a length of the wellbore with the drill bit as the drive shaft rotates.

17. The method of claim 15, further comprising directly attaching one or both of the generator coil and the one or more sensors to an outer surface of the drive shaft.

18. The method of claim 15, wherein one or both of the generator coil and the one or more sensors is arranged on a corresponding sleeve component, the method further comprising securing the corresponding sleeve component to the drive shaft for rotation therewith.

19. The method of claim 15, further comprising obtaining measurements with the one or more sensors while the drive shaft rotates, wherein the one or more sensors comprise downhole sensors selected from the group consisting of an inclination sensor, a gamma ray sensor, an azimuth sensor, a rotations-per-minute sensor, a weight-on-bit sensor, a torque-on-bit sensor, an axial sensor, a torsional sensor, a lateral vibration sensor, a temperature sensor, and a pressure sensor.

20. The method of claim 15, wherein one or more energy storage devices are coupled to the drive shaft and in direct electrical communication with the generator coil via the at least one electrical conductor element, the method further comprising:

conveying electrical power to the one or more energy storage devices with the generator coil to be stored as stored electrical power; and consuming the stored electrical power with at least one of the one or more sensors communicably coupled to the one or more energy storage devices.

* * * * *